United States Patent [19]

Jacobson

[11] 4,049,315

[45] Sept. 20, 1977

[54] CHAIR HAVING INDEPENDENT SEAT AND BACK

[76] Inventor: John D. Jacobson, 411 Temple St., New Haven, Conn. 06511

[21] Appl. No.: 750,114

[22] Filed: Dec. 13, 1976

[51] Int. Cl.[2] ..... A47C 1/12

[52] U.S. Cl. ..... 297/447; 297/294; 297/295; 297/420

[58] Field of Search ..... 297/294, 295, 420, 445, 297/447, 448

[56] References Cited

U.S. PATENT DOCUMENTS

| | | | |
|---|---|---|---|
| 1,791,453 | 2/1931 | Nies | 297/294 X |
| 3,815,955 | 6/1974 | Gibilterra | 297/295 |

FOREIGN PATENT DOCUMENTS

| | | | |
|---|---|---|---|
| 324,490 | 2/1935 | Italy | 297/295 |
| 170,985 | 11/1934 | Switzerland | 297/295 |
| 1,348,062 | 3/1974 | United Kingdom | 297/445 |

*Primary Examiner*—James C. Mitchell
*Attorney, Agent, or Firm*—DeLio and Montgomery

[57] ABSTRACT

A chair of unique styling and design having discrete members constituting a back and support therefor, a seat support and a seat. The back and support and seat support are connected together along the lower portions thereof at selected discrete points. The seat is also connected to the seat support at selected discrete points.

8 Claims, 5 Drawing Figures

CHAIR HAVING INDEPENDENT SEAT AND BACK

BACKGROUND OF THE INVENTION

The invention relates generally to the field of furniture and more specifically to light-weight chairs and chair frames having independent seats and backs.

In recent years, in furniture design it has become desirable to provide furniture having both great comfort and distinctive styling and design. With chairs, it is difficult to combine comfort, flexibility, and distinctive styling, where comfort is often dependent upon the resilience of the individual members forming the structure therof, and simultaneously requiring the chair to be sturdy enough to withstand years of use. Often comfort and styling has required the chair to be heavy and bulky, with thick padding and a large sturdy frame. These structures usually have relatively rigid frames relying on padded seats and backs for comfort, and are also costly to manufacture and purchase and tiring to move because of their great weight and bulk.

Heretofore, light-weight moderately-priced chairs have been constructed to metal tubing bent into a frame over which fabric or other seat material is placed. The frame has had to either be of sufficient rigidity to withstand the every-day stresses inherent in use, and therefore must be relatively rigid, or it would be too resilient, resulting in a chair having too short a lifetime. Furthermore, since the light-weight chair frames are usually of one or at most a few bent metal members, the structure would have the same torsional rigidity throughout for both the seat and the back. Light-weight chairs provided in the prior art have also suffered because of the difficulty of repairing them without replacing the entire chair.

SUMMARY OF THE INVENTION

It is therefore an object of the invention to provide a new and improved chair of unique design having improved comfort and modes of resilience.

It is a further object of the invention to provide a chair having an independent back and seat members and supports.

It is yet another object of the invention to provide a chair capable of having seat supports and back supports of differing torsional rigidities.

The invention provides a chair having a first member constituting a back and support therefor, a second member constituting a seat support and a third member constituting a seat. Both the back support and the seat support are adapted to be supported by the floor, and they are connected together through a plurality of spacers at selected mutually contiguous points along the bottom and sides thereof. The seat is supported by the seat support, also connected through a plurality of spacers disposed at mutually contiguous points. The forwardmost point of the seat is situated at or to the rear of the forwardmost point of contact between either the seat support or the back support and the floor, to insure that the chair does not tip over if someone sits on the front edge of the seat.

BRIEF DESCRIPTION OF THE DRAWINGS

The features of the invention which are believed to be novel are particularly pointed out and distinctly claimed in the concluding portion of this specification. The invention, however, both as to its organization and operation, together with further objects and advantages thereof, may best be appreciated by reference to the following detailed description taken in conjunction with the drawings, wherein:

DETAILED DESCRIPTION OF THE PREFERRED EMBODIMENTS

Figure 1:
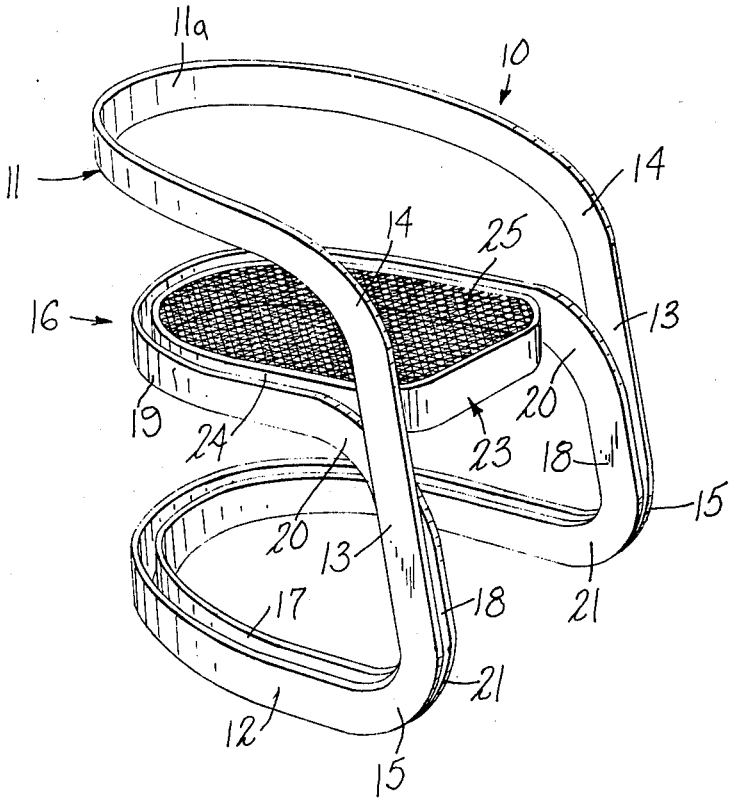
FIG. 1 is a perspective view of a chair according to the invention.

With reference to the drawing, the invention provides a chair 10 having a back member 11 comprising a U-shaped back rest 11*a*, a U-shaped base 12 and a pair of generally upright members 13 which support back rest 11*a* in cantilevered configuration elevated above base 12. Members 13 are preferably disposed at a seven degree angle with respect to the vertical toward the rear of the chair. Members 13 are joined to back rest 11*a* and support 12 through an upper curvilinear portion 14 and a lower curvilinear portion 15, respectively.

The invention further provides a seat support member 16 comprising a U-shaped lower member 17 and two generally upright members 18 supporting a U-shaped upper member 19 in a generally cantilevered configuration. Uprights 18 are joined to upper member 19 through an upper curvilinear portion 20 and to member 17 through a lower curvilinear portion 21. Lower member 17 is shaped to fit inside of back support 12, and space apart therefrom. The spacing is maintained, and base 12 is affixed to seat support 16, by means of five spacers 22, three of which are connected between base 12 and lower member 17, and the other two of which are positioned between upright member 13 and the contiguous upright member 18, approximately one-half of the way up members 18.

The chair also includes a seat 23 having a frame 24 and a cushion 25. Cushion 25 may be, for example, wicker, cane or any other suitable material. Frame 24 is shaped to fit inside of upper member 19, spaced apart therefrom, and is supported thereby by means of three spacers 26 connected at the sides and middle of the back of the frame 24.

Figure 5:
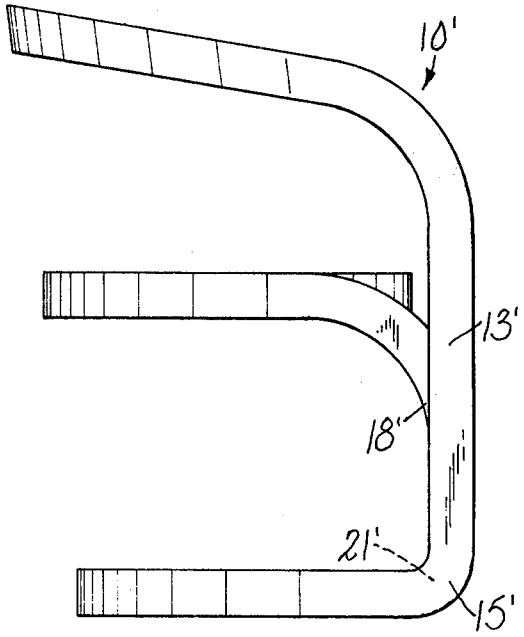
FIG. 5 shows a side view of modification of the chair shown in FIG. 1.

With reference to FIG. 5, a modified chair 10' is shown having uprights 13' and 18' which are substantially vertical. In modified chair 10', lower curvilinear portions 15' and the contiguous lower curvilinear portions 21' subtend right angles.

Figure 2:
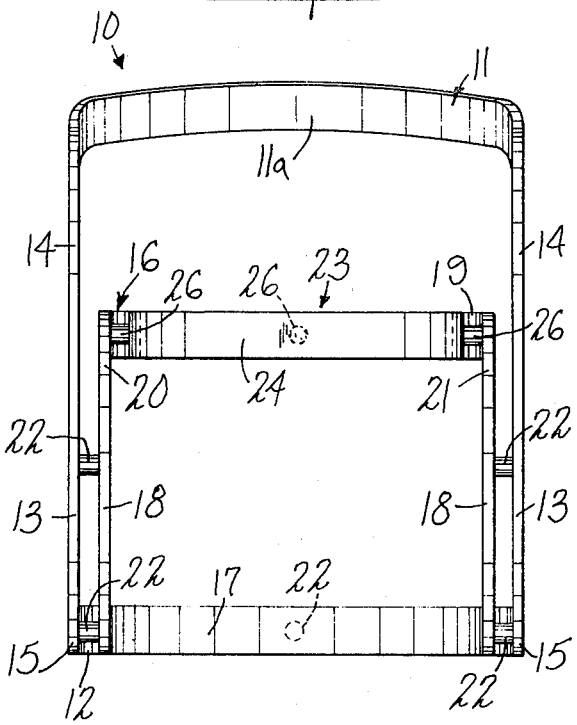
FIG. 2 shows a front view of the chair shown in FIG. 1.

In the preferred embodiments, the members comprising the chair, except for cushion 25 and spacers 22 and 26, have a rectangular cross-section elongated as shown in the figures. This allows the members to have torsional rigidities differing according to the direction of the applied stress and dependent upon the particular shape of the cross-section. The rectangular cross-sectional shape of the members further allows the chair back to more easily flex laterally to the left or to the right, as shown in FIG. 2, and simultaneously to provide sufficient rigidity in the vertical direction to support a person sitting on the seat.

Because the seat support 16 and the back 11 are of two separate pieces, different materials and cross-sections may be provided therefor, each member having a selected resilience.

Figure 3:
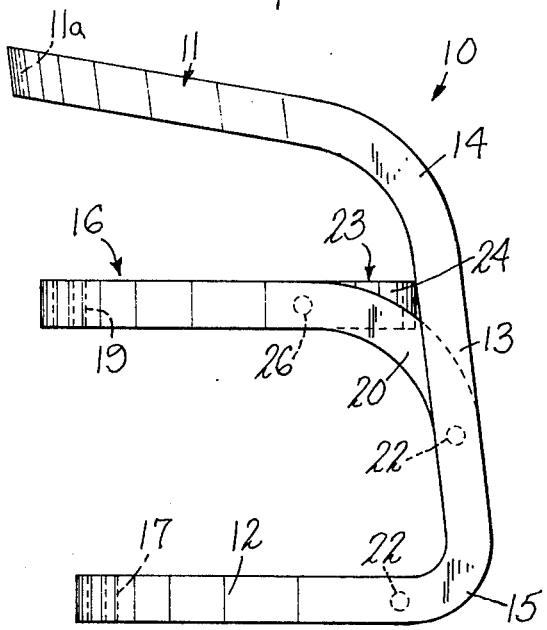
FIG. 3 shows a side view of the chair shown in FIG. 1.
Figure 4:
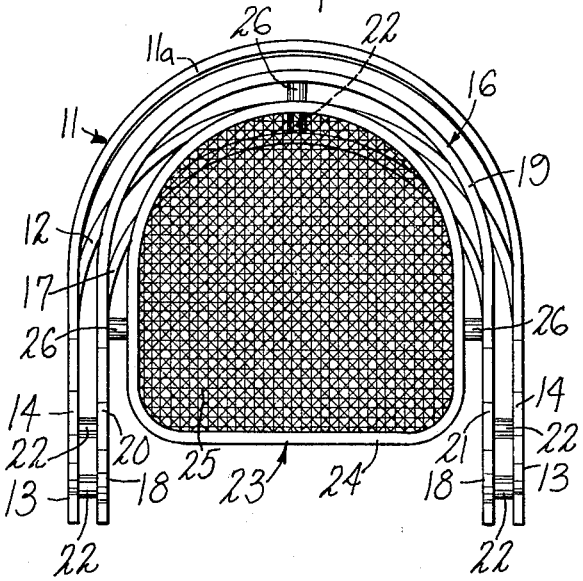
FIG. 4 shows a top view of the chair shown in FIG. 1.

With reference to FIGS. 3 and 5, upright members 13 and 13' and the contiguous members 18 and 18' are disclosed as being either slightly tilted back or vertical. It is to be understood that these two positions are for illustrative purposes only and that any orientation of members 13 and 18 is within the scope of the invention. It is, however, necessary for the forwardmost edge of seat frame 24 to be at or behind the forwardmost points at which either base 12 or lower member 17 touches the floor. This serves to reduce the possibility of the chair tipping over if someone sits on the forwardmost edge of frame 24.

It is also within the scope of the invention for the elements of the chair and the spacers to have a tubular or any other cross-section. It is to be understood that any number of spacers may be employed between back 11 and seat support 16 and between upper member 19 and frame 24. Back 11, base 12, and upright members 13 may be of a single piece of tubing bent into the shape of the elements shown in the figures, as may seat support 16. Furthermore, back rest 11*a*, base 12 and members 17 and 19 may be provided having shapes differing from the U-shape disclosed herein.

It can be seen that the objects of the invention have been efficiently attained. The invention provides a lightweight chair of distinctive styling in which the seat is suspended independently of the back, and in which the back, the seat support and the seat are interconnected at selected discrete points rather than continuously around the contiguous peripheries thereof. These features allow the seat and seat support to flex independently of the back without the use of springs extending from the floor or back, and also allow the chair back to rock to the left or right (as shown in FIG. 2) in response to movement by the person sitting therein. Furthermore, the chair provided by the invention is light in weight, is of distinctive styling, and may be easily repaired merely by the replacement of one of the members thereof.

While preferred embodiments of the invention have been set forth for purposes of the disclosure, modifications to the disclosed embodiment of the invention as well as other embodiments thereof may occur to those skilled in the art. Accordingly, the appended claims are intended to cover all embodiments which do not depart from the spirit and scope of the invention.

What is claimed is:

1. A chair comprising:

seat support means having a lower portion adapted to contact a floor and an elevated portion supported in cantilevered fashion;

seat means having a periphery adapted to be supported by said seat support means;

spacer means adapted to be connected to said elevated portion and said periphery at preselected discrete points thereof to support said means at a preselected height above the floor;

back means comprising back support means adapted to contact a floor and an elevated back portion supported in cantilevered fashion above said seat means by said back support means; and further spacer means adapted to be connected to said back support means and said lower portion of said seat support means at preselected points thereof.

2. A chair as defined in claim 1 wherein each of said lower portion, said elevated portion, said periphery, said back means and said back support means include a U-shaped member, said spacer means and said further spacer means being adapted to be connected to said U-shaped members.

3. A chair as defined in claim 1 wherein said support means includes generally-upright members supporting said elevated portion above said lower portion and wherein said back support means includes generally-upright members.

4. A chair as defined in claim 3 wherein all of said generally-upright members are angled at a slight angle toward the rear of the chair.

5. A chair as defined in claim 3 wherein all of said generally-upright members are vertical.

6. A chair as defined in claim 1 wherein the forwardmost point of said seat means is at or behind the forwardmost point at which said lower portion of said back support means or seat support means contacts the floor.

7. A chair as defined in claim 1 wherein said seat means, seat support means, said back means and said back support means all have rectangular cross-section elongated in the vertical direction.

8. A chair as defined in claim 1 wherein said seat means, seat support means, said back means and said back support means are all tubular.

* * * * *